US005927059A

United States Patent [19]

Goertz

[11] Patent Number: 5,927,059

[45] Date of Patent: Jul. 27, 1999

[54] METHOD AND APPARATUS FOR CREATING COILED CRAFT STOCK

[76] Inventor: LeRoy W. Goertz, 3924 SE. 71st, Portland, Oreg. 97206-2534

[21] Appl. No.: 08/886,872

[22] Filed: Jul. 2, 1997

[51] Int. Cl.[6] ..... D02G 3/36

[52] U.S. Cl. ..... 57/3; 57/11; 57/12; 57/18; 57/25; 140/39; 140/119

[58] Field of Search ..... 57/3, 11, 6, 12, 57/18, 25, 59, 60, 64; 72/371, 298, 299; 140/39, 47, 119, 122

[56] References Cited

U.S. PATENT DOCUMENTS

| | | | |
|---|---|---|---|
| 827,552 | 7/1906 | McCloud . | |
| 983,911 | 2/1911 | Linn . | |
| 997,754 | 7/1911 | Clawson . | |
| 1,326,766 | 12/1919 | Moore . | |
| 1,336,649 | 4/1920 | Musson | 57/11 |
| 3,030,984 | 4/1962 | Vogt et al. | 140/122 |
| 4,704,855 | 11/1987 | Yoshida et al. | 57/58.54 |
| 4,910,954 | 3/1990 | Tizzi | 59/18 |

*Primary Examiner*—William Stryjewski
*Attorney, Agent, or Firm*—Klarquist Sparkman Campbell Leigh & Whinston, LLP

[57] ABSTRACT

An exemplary apparatus is a jig including a chuck having a plurality of radially movable members for controllably gripping a member inserted in an axial bore extending therethrough. The chuck is mounted on a hollow tube whose axis is collinear with the bore of the chuck. This jig is used by first positioning a first elongated member (e.g. a first, or "inner" wire) in the axial bore of the chuck, and tightening the radially movable members thereon. The distal end of a second elongated member (e.g. a second, or "outer" wire) is secured in a fixed relationship with the chuck, so that the distal end turns with the chuck. The chuck is then rotated so as to rotate the first, inner wire. As this inner wire is rotated, the operator trains the second wire thereagainst, thereby yielding a length of coil with the inner wire extending therethrough. After a length of coil has thus been produced, the chuck is opened and the first wire, with the second wire now coiled thereabout, is inserted into the chuck (and, therethrough, into the hollow tube), and the chuck tightened onto the coiled second wire. The operator then resumes training the second wire against the rotating first wire, extending the length of the coil earlier formed. By alternately coiling wire, and then moving the coil thus formed into the chuck (and ultimately into the hollow tube), coiled stock of arbitrary length can be quickly and simply produced—a feat not possible with prior art techniques.

18 Claims, 3 Drawing Sheets

METHOD AND APPARATUS FOR CREATING COILED CRAFT STOCK

FIELD OF THE INVENTION

The present invention relates to simple and inexpensive techniques for producing coiled materials of the sort commonly used as raw materials in craft projects.

BACKGROUND AND SUMMARY OF THE INVENTION

Coiled materials find many uses in craft projects. One example is the jewelry field, in which coiled materials (e.g. coiled wire) can be fashioned into bracelets, necklaces, earrings, beads, broaches, hair adornments, etc.

In the prior art, the most ancient technique for coiling wire is still the most common. This involves holding one wire in one hand, and physically coiling a second wire repeatedly around the first.

Another technique is to begin a coil and insert the coil into a vise with Teflon blocks. A hand crank drill then turns the wire and coils are made.

Jewelry makers sometimes make "jump rings" (the coupling rings commonly used, e.g., to join components in a necklace) by rotating a guide fixture, and guiding a wire to form a few coils therearound. The guide fixture may be turned by placing same into, e.g., a rotating chuck. This approach is not suitable, however, for producing long lengths of coil. Nor is it suitable for coiling of one flexible wire about another.

Accordingly, there is a long-felt need for a simple, inexpensive device that may be used by hobbyists to form coiled materials for use in various craft projects.

This need is met, in one embodiment of the present invention, by a novel jig and its method of use. The jig includes a chuck having a plurality of radially movable members for controllably gripping a member inserted in an axial bore extending therethrough. The chuck is mounted on a hollow tube whose axis is collinear with the bore of the chuck. This jig is used by first positioning a first elongated member (e.g. a first, or "inner" wire) in the axial bore of the chuck, and tightening the radially movable members thereon. The distal end of a second elongated member (e.g. a second, or "outer" wire) is secured in a fixed relationship with the chuck, so that the distal end turns with the chuck. The chuck is then rotated so as to rotate the first, inner wire. As this inner wire is rotated, the operator trains the second wire thereagainst, thereby yielding a length of coil with the inner wire extending therethrough. After a length of coil has thus been produced, the chuck is opened and the first wire, with the second wire now coiled thereabout, is inserted into the chuck (and, therethrough, into the hollow tube), and the chuck tightened onto the coiled second wire. The operator then resumes training the second wire against the rotating first wire, extending the length of the coil earlier formed. By alternately coiling wire, and then moving the coil thus formed into the chuck (and ultimately into the hollow tube), coiled stock of arbitrary length can be quickly and simply produced—a feat not possible with prior art techniques.

In addition to its other advantages over the prior art, it will be recognized that the foregoing technique also avoids excessive work-hardening, which may result in fracturing of the final product.

The foregoing and additional features and advantages of the present invention will be more readily apparent from the detailed description, which proceeds with reference to the following drawings.

DETAILED DESCRIPTION

Figure 1:
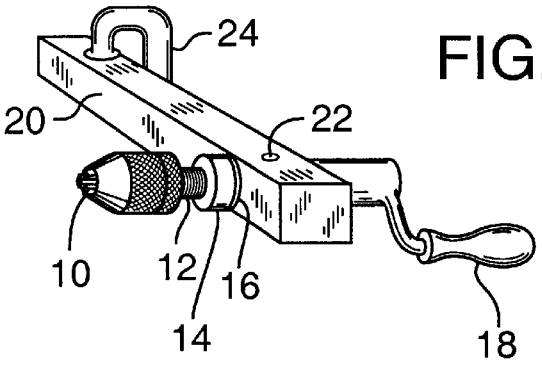
FIG. 1 is a view of a coiling jig according to a first embodiment of the present invention.

Referring to FIG. 1, a first embodiment of the present invention includes a chuck 10, a hollow tube 12, a stop collar 14 (with associated set screw—not shown), a nylon washer 16, and a crank 18. The jig is built around a main bar 20, which in the illustrated example is fashioned from a 1"×1" aluminum block.

The illustrated chuck 10 has a plurality of radially movable members 21 therein (FIGS. 1A, 1B), permitting gripping of a member inserted into the throat thereof. This chuck is of a type wherein the throat (bore) extends all the way through the chuck. Female threads on the inside of this bore permit mounting of the chuck into threads cut onto the outside of the hollow tube 12.

The bar 20 is drilled to permit passage of the hollow tube 12 therethrough and rotation of the tube therein. The tube 12 is secured in place relative to the bar by the stop collar 14 on one side, and the crank (which mounted on the outside of tube 12) on the other. An oil hole 22 permits lubrication of the tube 12 where it passes through the bar. By this arrangement, when the crank 18 is turned, the tube 12 turns and, with it, chuck 10.

The jig is secured in place by a C-clamp 24 or the like, which fastens the jig to a work surface (not shown).

As summarized above, a first ("inner") wire 17 (FIG. 5) is positioned in the throat of the chuck 10, and the radially movable chuck members are tightened thereon. The distal end of a second ("outer") wire 19 is secured to the chuck, e.g. by insertion into the small gap between two of the chuck's radially movable members 21. By this arrangement, the distal end of the outer wire turns with the chuck.

With the wires thus arranged, the chuck is then rotated. As the inner wire is rotated, the operator trains the second wire othogonally thereagainst and (slowly) laterally therealong, thereby yielding a length of coiled stock 23 (FIG. 5) with the inner wire 17 extending therethrough. After a length of coil has thus been produced, the chuck is opened and the first wire, with the second wire now coiled thereabout, is inserted into the throat of the chuck (and, therethrough, into the hollow tube 12), and the chuck is then tightened onto the coiled second wire. The operator then resumes training the second wire against the rotating first wire, extending the length of the coil earlier formed. By alternately coiling wire, and then moving and regripping the coil thus formed in the chuck (so that the coil eventually extends through the chuck and into the hollow tube 12), coiled stock of arbitrary length is quickly and simply produced. Such a coil is shown in FIG. 5.

Many crafts make direct use of the coil thus produced, without further use of the coiling jig. Some crafts, however, do make further use of the jig. An example is a coiled bead of the type shown in FIG. 6C.

Figure 5:
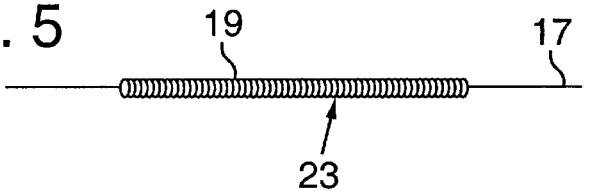
FIG. 5 is a view of coiled wire stock that can be produced by the jigs of FIGS. 1, 3, or 4.
Figure 6A:
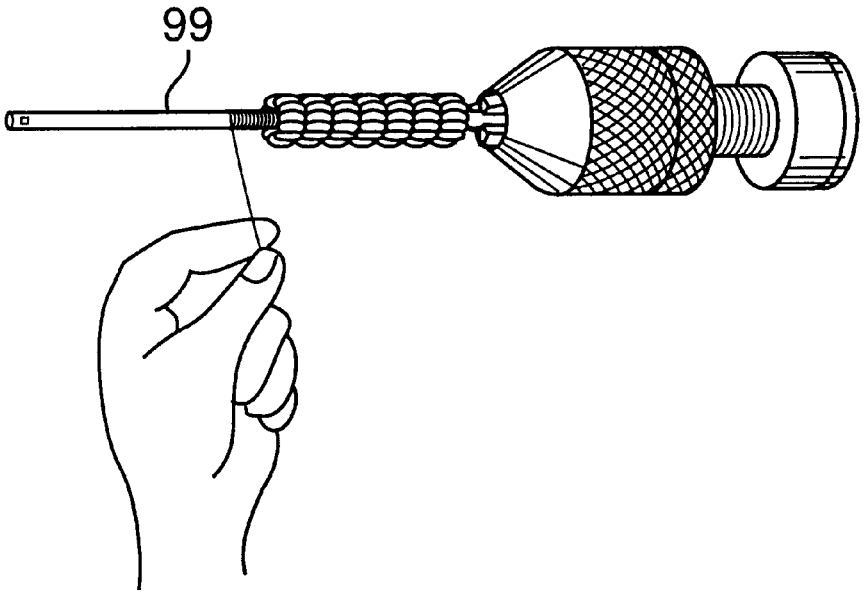
FIGS. 6A, 6B, and 6C shows steps in the formation of a coiled bead from the coiled wire stock of FIG. 5.
Figure 6B:
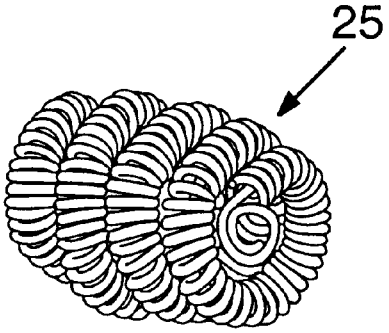
Figure 6C:
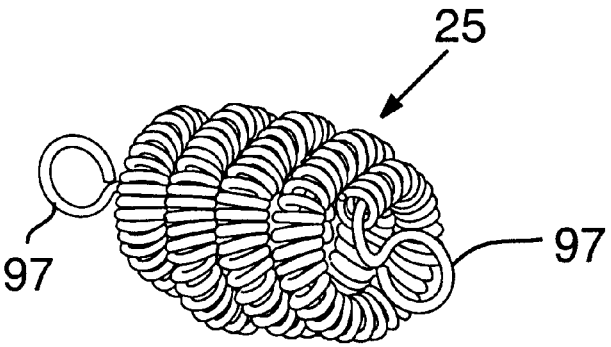

To make the coiled bead 25 of FIG. 6C, the user first produces about eight to ten inches of coiled stock, e.g. of the sort 23 illustrated in FIG. 5. This stock is then re-coiled—typically over a larger center member. FIG. 6A shows this process of recoiling over a metal rod 99. (Other larger center members, including non-cylindrical shapes, can of course be used.) The shape of the bead is then adjusted, as necessary, by pliers to result in the bead shape shown in FIG. 6B. Finally, the two ends of the center wire extending from the coiled stock are fashioned, by pliers, into coupling loops 97 (FIG. 6C).

Figure 1A:
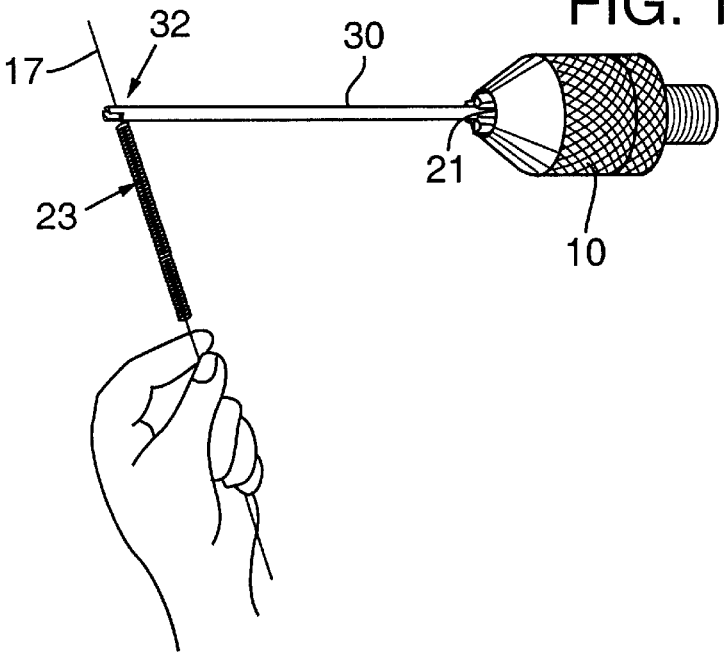
FIGS. 1A and 1B show how a once-coiled material can be engaged in the jig of FIG. 1 to effect a second, recoiling operation, e.g. to form a craft bead.

One way to effect the recoiling is shown in FIG. 1A. In this arrangement, a dowel 30 (or metal rod or the like) is secured in the jaws of the chuck 10. The exposed end 32 of the dowel has a slot cut therein. The inner wire 17 protruding from the end of the 8–10" coiled stock formed earlier is positioned in the slot. The chuck is then turned, and the coiled stock is wrapped back along the dowel, towards the chuck. After all of the stock is recoiled, it is slid off the exposed end of the dowel 30 and finished as described above.

Figure 1B:
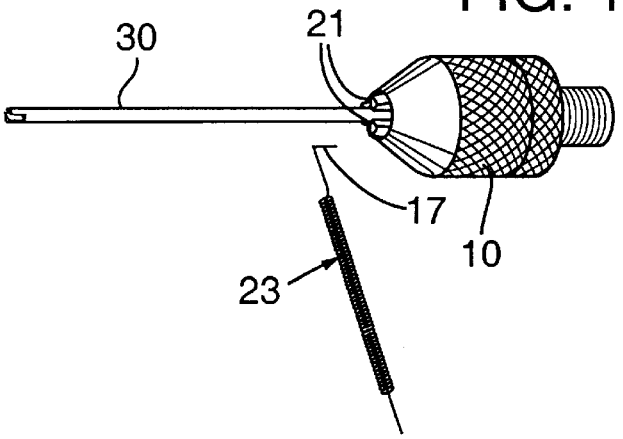

Another way to effect the recoiling is shown in FIG. 1B. In this arrangement, a dowel 30 is again secured in the jaws of the chuck. In this arrangement, however, the inner wire 17 protruding from the end of the 8–10" coiled stock 23 is inserted between the movable jaw members 21 of the chuck—off the axis of the dowel (in the same manner as the outer wire was earlier secured to the chuck when the coiled stock was first formed). Again, the operation proceeds by turning the chuck, and recoiling the stock on the dowel—this time progressing away from the chuck. After the stock is recoiled, it is slid off the exposed end of the dowel and finished as described above.

In other methods, instead of re-coiling the stock over a removable form (such as a dowel), the stock can be re-coiled over an article that is thereafter left in place to form part of the finished bead. In such an arrangement, this component article can be secured within the throat of the chuck, and the chuck (and article) rotated to permit the wrapping of the coiled stock therearound.

The selection of wire size and type depends on artistic and structural considerations. An exemplary implementation uses 20 gauge copper wire for the inner wire 17, and 22 gauge sterling silver wire for the outer wire 19. Wire sizes ranging from at least 16 to 26 gauge can be used, and others may be possible as well. Usually a larger wire is used for the inner wire, but sometimes it is desirable to use the same sized wire for both, or use a larger wire on the outside.

Figure 2:
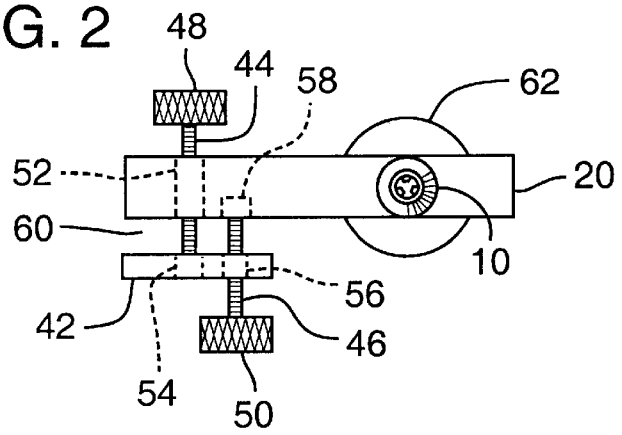
FIG. 2 is a view of a mounting clamp which may be used to secure the jig of FIG. 1 to a work surface.

While the FIG. 1 embodiment was described as employing a C-clamp to secure same to a work surface, a generally more desirable clamping arrangement 40 is shown in FIG. 2. In this figure the apparatus includes the main bar 20 and a chuck 10, as described above. (Additionally, this figure shows a take-up spool 62, more particularly described in connection with the FIG. 3 embodiment, below.) The clamping arrangement 40 includes a clamp bar 42, and first and second threaded bolts 44, 46—each with gripping handles 48, 50 on the head thereof.

The first bolt 44 first passes through an unthreaded bore 52 in the main bar 20, and then threads into female threads 54 that pass through the clamp bar 42. The second bolt 46 first passes through female threads 56, and thence into an unthreaded seat 58 in the main bar 20.

In use, the work surface (e.g. a table top) is positioned in the gap 60 between the main bar 20, the clamp bar 42, and the first bolt 44. The gripping handle 48 of the first bolt is then turned to bring the facing surfaces of the two bars 20, 42 into engagement with opposing surfaces of the table top. Next, the gripping handle 50 of the second bolt 46 is turned to urge the two bars apart in the vicinity of the second bolt. This has the effect of urging the two bars together on the opposite side of the first bolt 44, snugging the bars into tighter engagement with the table top. This lever action of clamping bar 42 about bolt 44 affixes the coiling apparatus more securely to a table top than can be achieved with the C-clamp approach of FIG. 1.

Figure 3:
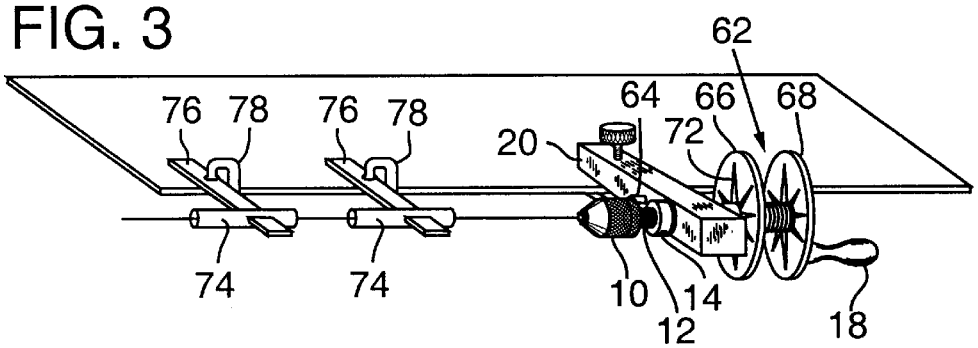
FIG. 3 is a view of a coiling jig according to a second embodiment of the present invention.

FIG. 3 shows a second embodiment of a coiling apparatus. Like the embodiment of FIG. 1, the FIG. 3 embodiment includes a chuck 10, a hollow tube 12, a stop collar 14, a nylon washer, and a crank 18, all built about a main bar 20. Additionally included in the FIG. 3 embodiment are a take-up spool 62, a brake assembly 64, and a plurality of "outriggers" 66.

The take-up spool 62 (formed of circular metal spoked wheels 66 and 68 mounted on the outside of the hollow tube 12) is used to collect finished coiled stock that has extended out of the hollow tube near the crank 18, and which would otherwise droop down and possibly torque as rotation of the hollow tube continued. After the first six inches—or so —of coiled stock is produced, the stock protruding out the crank end of the hollow tube 12 is wrapped around the spool 62 each time more coiled stock is passed through the bore of the chuck 10.

The brake assembly 64 includes a movable member that prevents undesired rotation of the chuck 10. In the illustrated embodiment, this movable member takes the form of a pin slidably mounted in a bore through main bar 20. This pin can be selectively extended through the bar and into mechanical engagement with spokes 72 of wheel 66 of the take-up spool 62. When the pin is thus extended, the disk 66, and thus the chuck 10, are prevented from rotating. Locking the chuck in this fashion greatly facilitates the loosening and tightening of the chuck jaws, operations which are performed repeatedly in the above-described method of operation. For example, with the pin extended to its "lock" position, the chuck can be both loosened and tightened with a single hand, allowing the operator's other hand to be dedicated to other tasks.

The outriggers 66 provide support of the first, central wire at locations remote from the chuck 10, facilitating use of this embodiment with long lengths of wire. Each outrigger 66 comprises a hollow shaft 74 affixed to the end of a bar 76, the opposite end of which is clamped to a work surface by, e.g., a C clamp 78.

Figure 4:
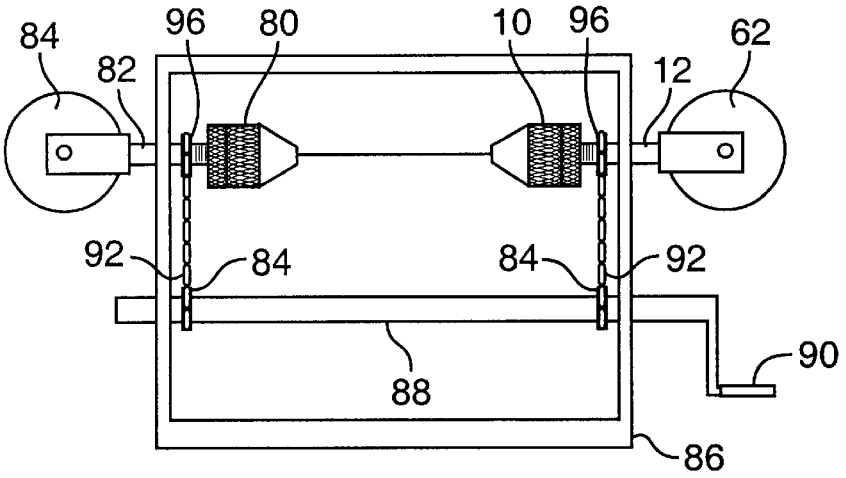
FIG. 4 is a view of a coiling jig according to a third embodiment of the present invention.

FIG. 4 shows a third, "loom" embodiment of the coiling apparatus. Like the foregoing embodiment, this embodiment includes a chuck I 0, a hollow shaft 12, and a take-up spool 62. (In this embodiment, the take up spool is oriented with its axis transverse of the hollow shaft 12—an arrangement that can likewise be employed in the FIG. 3 embodiment.)

New in FIG. 4 is a second chuck 80, a second hollow tube 82, an inner wire supply reel 84, a frame 86, a drive shaft 88, a crank 90, and a pair of drive chains 92, each with associated sprockets 94, 96. Drive shaft 88 is journaled at its two ends in the frame 86. The crank 90 is mounted to an end 98 of the drive shaft that extends slightly beyond the frame. Mounted on the drive shaft 88 are two sprockets 94, through which drive power is applied to the first and second hollow tubes 12, 82 through the chains 92 and hollow tube sprockets 96.

The first and second hollow tubes 12, 82, are also each journal led in the frame, and extend out therefrom to support the inner wire supply reel 84 and the take up spool 62, respectively.

In operation, an inner wire is first extended from reel 84, through hollow tube 82, through chuck 80, across a reach 100, and into chuck 12. The two chucks are then tightened. A second, outer wire is secured to chuck 12 in the manner described above. Crank 90 is then turned, causing the chucks (10, 80), the hollow tubes (12, 82), and the reel/spool (84, 66) to rotate in tandem. As described above, the second wire is then trained around the inner wire, forming a coil that extends from chuck 10 towards chuck 80. This coiling operation continues until the coil extends all the way across reach 100 to chuck 80.

Both chucks are then loosened, and the coiled stock just produced is moved to the right in the figure, through the throat of chuck 10 and into hollow tube 12. Any coiled stock extending out the right end of hollow tube 12 is wrapped around take up spool 66. The chucks are then retightened (chuck 80 is retightened on the inner wire alone; chuck 10 is tightened on newly-coiled stock), and the just-described wrapping operation is repeated.

By use of this loom embodiment, arbitrarily long lengths of coiled stock can readily be formed at a fast pace.

In all of the foregoing embodiments, the second wire is trained about the outside of the inner wire. The precise placement of this second wire during this training operation is accomplished—in the most rudimentary methods of the invention—by holding the second wire between the operator's thumb and index finger, and letting it slip therethrough as it coils about the inner wire. This manual positioning of the second wire assures that the wraps of the second wire about the first are all adjacent (assuming that this is what is desired).

Another arrangement—still relying on manual positioning of the second wire as it wraps about the first—is to employ a ring clamp. Ring clamps are well known to jewelers as simple lever-based devices for gripping a ring so that it may, e.g., be securely held against a polishing wheel. In this method, the second wire is passed through the ring Ads clamp, and the ring clamp is positioned as desired next to the inner wire to position the second wire as it coils therearound. (The clamp is not fully tightened, so that the second wire can draw through the clamp to coil about the inner wire.)

In more sophisticated embodiments (e.g. a variant of the FIG. 4 embodiment), operator positioning of the second wire against the first can be obviated by a mechanism which automatically and continuously repositions the point along the inner wire at which the outer wire is trained thereagainst. In one such embodiment, the drive shaft 88 is threaded with a thread having the same pitch as the desired coil. A pinch clamp is then mounted on a nut that travels down the drive shaft as the shaft rotates, and the second wire is routed through the pinch clamp. As the clamp travels linearly down the threaded drive shaft, the point of application of the second wire against the first likewise progresses down the first wire, mechanically controlled by the geometry of the threads on the drive shaft.

In most embodiments, a single outer wire is coiled about a single inner wire. But this need not be the case. Interesting effects can be obtained by employing two or more wires for the "inner" wire. (Two wires will tend to lie side by side, creating coiled stock with a flat aspect. Simple fixtures can be devised to hold plural wires flat within the jaws of the rotating chuck.) Likewise it is sometimes desirable to coil two or more wires about an inner wire. A silver and a copper wire, side by side, for example, gives a pleasing visual effect. Moreover, plural outer wires need not all be coiled in the same operation. For example, a relatively large wire can first be coiled about an inner wire. Then, in a subsequent operation, a relatively smaller wire can be coiled thereon—between the wraps of the larger wire.

Having described and illustrated the features of my inventive work with reference to a variety of embodiments thereof, it should be apparent that these embodiments can be varied in arrangement and detail without departing from the general principles of my invention. For example, while I have described the fabrication of coiled stock useful in making articles of jewelry, it will be recognized that coiled materials have other craft uses as well. Stock for baskets, ornaments, and sculpture are but a few examples. Similarly, while I most commonly use wires of sterling silver and copper, it will be recognized that other types of wire, including gold, bronze, colored, etc., can alternatively be used. Likewise, while I have described the coiling of wire onto wire, it will be recognized that elongated component materials other than wire can alternatively be used. (I sometimes find it desirable to coil wire onto string, for example. If string, or another limp medium, is used as the base onto which a material is coiled, it is helpful to provide means for holding the string taut. This is readily accomplished in the third embodiment by stretching the string taught between the two chucks. In other embodiments, the string may be kept taught between a single chuck and a fixed object to which the end of the string is attached through, e.g., a swivel.)

Still further, it will be apparent to those skilled in the art that various of the mechanical components of the illustrated embodiments can be substituted with other components.

The chuck, for example, may take the form of a clamp or components that holds the wire(s), etc., in place with a set screw arrangement. Similarly, the direct drive or chain drive systems can be replaced with ones employing gears (including worm drive arrangements). The stop collar 14/washer 16 arrangement can be replaced with an oil-impregnated bushing that is press-fit into an oversize bore formed in the main bar 20. Myriad other arrangements can, of course, be employed—each providing its own advantages, in accordance with the particular application being addressed.

In view of the foregoing, it should be recognized that the arrangements described above illustrate but a few of the many forms my inventive work may take, and should not be understood as limiting the scope of my invention. Rather, I claim as my invention all such embodiments as may fall within the scope and spirit of the following claims, and equivalents thereto.

I claim:

1. A method for producing coiled stock useful in decorative craft objects by using a jig, the jig comprising a chuck and a hollow tube, the chuck including one or more movable member(s) for controllably gripping a member inserted in an axial bore extending therethrough, said chuck being mounted so the axis thereof extends through a hollow bore defined by said tube, the method comprising:

(a) positioning a first elongated member in the axial bore of the chuck;

(b) tightening the movable member(s) of the chuck so as to secure the first elongated member in the axial bore;

(c) securing the distal end of a second elongated member in a fixed relationship with the chuck so said distal end moves with said chuck;

(d) rotating the chuck to thereby rotate the first elongated member and the secured distal end of the second elongated member;

(e) training a portion of the second elongated member against the rotating first elongated member to wrap the second elongated member therearound, thereby yielding a length of coil comprising the first elongated member with the second elongated member wrapped therearound;

(f) opening the movable member(s) of the chuck;

(g) inserting the length of coil into the chuck and tightening the movable member(s) thereon; and (h) continuing rotating the chuck and training a further portion of the second elongated member around the rotating first elongated member.

2. The method of claim 1 in which the movable members of the chuck include first and second radially movable jaws, and said securing step includes securing the distal end of said second elongated member between the first and second radially movable jaws of said chuck.

3. The method of claim 1 in which said securing step includes securing the distal end of the second elongated member into a receptacle therefor on the first elongated member.

4. The method of claim 3 in which the receptacle is a slot in an end of the first elongated member.

5. The method of claim 1 in which the chuck is mounted to the tube, so the tube rotates with the chuck.

6. The method of claim 1 in which the first elongated member is wire.

7. The method of claim 1 in which the first elongated member is a rigid shaft.

8. The method of claim 1 which further includes repeating steps (f), (g), and (h), allowing the length of coil to extend into the hollow bore of the tube.

9. A jig for producing decorative craft items, comprising a chuck, a tube, a base, and a drive system;

the chuck having one or more radially movable member (s) for controllably gripping a first elongated member inserted in an axial bore extending therethrough;

said chuck being mounted to the tube so the axis of the chuck passes through a hollow bore defined by said tube, wherein said first elongated member can extend through the chuck and into said hollow bore of the tube;

the base defining a bore through which the tube passes and within which the tube can rotate; and the drive system being arranged to rotate the tube, and the chuck mounted thereon.

10. The jig of claim 9 further including a brake, the brake being mechanically coupled to the base and arranged to prevent rotation of the tube and chuck.

11. The jig of claim 10 which further includes a radial member rigidly coupled to, and extending radially away from, the tube, said brake comprising a movable member that is selectively extendible from the base to mechanically engage said radial member to prevent rotation of said tube.

12. The jig of claim 11, win which said radial member is a first wheel member having spokes with which the movable member engages when extended.

13. The jig of claim 12, in which the jig includes a second wheel member mounted to, and extending radially away from, the tube, said first and second wheel members defining a take up spool about which material protruding through the tube may be coiled.

14. The jig of claim 10 in which said brake comprises a pin slidably mounted in a bore through said base.

15. The jig of claim 9 further including a second chuck mounted to a second tube, the drive system being arranged to cause the first and second chucks to rotate in tandem.

16. A jig for producing decorative craft items, comprising a chuck, a tube, a base, a drive system, and a take up spool;

the chuck having one or more radially movable member (s) for controllably gripping a first elongated member inserted in an axial bore extending therethrough;

said chuck being mounted to the tube so the axis of the chuck passes through a hollow bore defined by said tube, wherein said first elongated member can extend through the chuck and into said bore;

the base defining a bore through which the tube passes and within which the tube can rotate;

the drive system being arranged to rotate the tube, and the chuck mounted thereon;

the take up spool being positioned to rotate with the chuck and to spool material protruding from the chuck through the tube.

17. A jig for producing coiled stock useful in decorative craft items, the jig comprising a rotatable assembly including a first component for gripping at least a first elongated member and turning same to facilitate wrapping a second elongated member therearound, said first component having a bore extending completely therethrough, the assembly further including a take-up spool rotatable with said assembly, wherein at least the first elongated member can pass completely through said component and be stored on said take-up spool.

18. A method for producing coiled stock useful in decorative craft items comprising:

gripping a first elongated member in a mechanism;

rotating the gripped first elongated member and wrapping a second elongated member therearound, thereby forming a length of coil with the first elongated member extending therefrom;

releasing said grip on the first elongated member, and gripping the length of coil with said mechanism; and rotating the gripped length of coil while continuing to wrap the second elongated member around the first elongated member extending from said length of coil, thereby lengthening said coil.

* * * * *